US010243302B2

(12) United States Patent
Ju

(10) Patent No.: US 10,243,302 B2
(45) Date of Patent: Mar. 26, 2019

(54) ELECTRICAL CONNECTOR

(71) Applicant: LOTES CO., LTD, Keelung (TW)

(72) Inventor: Ted Ju, Keelung (TW)

(73) Assignee: LOTES CO., LTD, Keelung (TW)

( * ) Notice: Subject to any disclaimer, the term of this patent is extended or adjusted under 35 U.S.C. 154(b) by 26 days.

(21) Appl. No.: 15/722,097

(22) Filed: Oct. 2, 2017

(65) Prior Publication Data

US 2018/0097313 A1 Apr. 5, 2018

Related U.S. Application Data

(60) Provisional application No. 62/404,395, filed on Oct. 5, 2016.

(30) Foreign Application Priority Data

Jan. 12, 2017 (CN) ..... 2017 2 0033715 U

(51) Int. Cl.

| | |
|---|---|
| ***H01R 33/00*** | (2006.01) |
| ***H01R 13/646*** | (2011.01) |
| ***H01R 13/04*** | (2006.01) |
| ***H01R 13/648*** | (2006.01) |
| ***H01R 13/652*** | (2006.01) |

(Continued)

(52) U.S. Cl.

CPC ..... *H01R 13/646* (2013.01); *H01R 9/03* (2013.01); *H01R 13/04* (2013.01); *H01R 13/20* (2013.01); *H01R 13/405* (2013.01); *H01R 13/631* (2013.01); *H01R 13/6485* (2013.01); *H01R 13/652* (2013.01); *H01R 13/6581* (2013.01); *H01R 13/6591* (2013.01);

(Continued)

(58) Field of Classification Search

CPC ..... H01R 23/7073; H01R 23/7005
USPC ..... 439/660, 626, 374, 377, 79, 733
See application file for complete search history.

(56) References Cited

U.S. PATENT DOCUMENTS 9,761,987 B2 * 9/2017 Ting ..... H01R 13/521
9,843,148 B2 * 12/2017 Little ..... H01R 24/60

(Continued)

FOREIGN PATENT DOCUMENTS

CN 204156224 U 2/2015
CN 204696372 U 10/2015

(Continued)

*Primary Examiner* — Phuong Chi T Nguyen
(74) *Attorney, Agent, or Firm* — Locke Lord LLP; Tim Tingkang Xia, Esq.

(57) ABSTRACT

An electrical connector includes an insulating body having a base and a tongue located at the front end of the base, a shielding shell sleeved outside the base and the tongue and forming a mating space, and multiple upper-row terminals and multiple lower-row terminals fixed on the base. Each upper-row and lower row terminal has a contacting portion exposed from the upper or lower surface of the tongue, a soldering portion extending out of the base, and a connecting portion located between the contacting portion and the soldering portion. The upper-row terminals and the lower-row terminals include respectively at least one upper-row ground terminal and at least one lower-row ground terminal. An extending portion extends from each of the connecting portions of the upper-row ground terminal and the lower-row ground terminal, and the cutting surface of each extending portion urges against the shielding shell.

13 Claims, 13 Drawing Sheets

(51) Int. Cl.

| | |
|---|---|
| ***H01R 13/6581*** | (2011.01) |
| ***H01R 24/60*** | (2011.01) |
| ***H01R 13/20*** | (2006.01) |
| ***H01R 13/6591*** | (2011.01) |
| ***H01R 9/03*** | (2006.01) |
| ***H01R 13/405*** | (2006.01) |
| ***H01R 13/631*** | (2006.01) |
| ***H01R 13/6594*** | (2011.01) |
| ***H01R 13/6597*** | (2011.01) |
| ***H01R 43/02*** | (2006.01) |

(52) U.S. Cl.
CPC ..... *H01R 13/6594* (2013.01); *H01R 13/6597* (2013.01); *H01R 24/60* (2013.01); *H01R 43/0256* (2013.01)

(56) References Cited

U.S. PATENT DOCUMENTS

| | | | | |
|---|---|---|---|---|
| 9,871,318 | B2 * | 1/2018 | Wang | H01R 13/5202 |
| 9,871,326 | B2 * | 1/2018 | Zhao | H01R 13/6581 |
| 9,893,468 | B2 * | 2/2018 | Zhao | H01R 13/64 |
| 2016/0099526 | A1 * | 4/2016 | Chen | H01R 13/5045<br>439/607.05 |
| 2017/0194748 | A1 * | 7/2017 | Peng | H01R 13/6581 |

FOREIGN PATENT DOCUMENTS

| | | | |
|---|---|---|---|
| CN | 205355424 | U | 6/2016 |
| CN | 205452703 | U | 8/2016 |
| TW | M499682 | U | 4/2015 |
| TW | M526206 | U | 7/2016 |

* cited by examiner

ELECTRICAL CONNECTOR

CROSS-REFERENCE TO RELATED APPLICATION

This application claims priority and the benefit of U.S. Provisional Application No. 62/404,395, filed on Oct. 5, 2016, the entire contents of which are hereby incorporated by reference.

FIELD OF THE INVENTION

The present invention relates to an electrical connector, and more particularly to an electrical connector capable of reducing electromagnetic interference.

BACKGROUND OF THE INVENTION

With the development of electronic technique, the frequency and speed of signals transmitted by an electrical connector tend to be higher. Therefore, the requirement for a shielding structure of the electrical connector is higher. It is required that the shielding structure have a higher and more stable grounding effect, so as to meet the requirement of modern society for a high-frequency transmission performance of the electronic connector.

An existing electrical connector with a shielding structure includes an insulating body. The insulating body is provided with multiple signal terminals and at least one ground terminal. Each ground terminal has a fixing portion and a soldering portion extending backward from the fixing portion. Each fixing portion is fixed to the insulating body. Each soldering portion is soldered to a circuit board to be grounded. A shielding shell is sleeved over the insulating body to shield outside signal interference on the signal terminals, so as to form a shielding structure.

However, since the soldering portion is only soldered onto the circuit board for grounding, if the soldering portion is soldered poorly or gets loose, the signal transmission of the signal terminals will be affected, and as a result, the high-frequency transmission performance of the electrical connector will be affected.

Therefore, a heretofore unaddressed need exists in the art to address the aforementioned deficiencies and inadequacies.

SUMMARY OF THE INVENTION

In one aspect, the present invention relates to an electrical connector capable of reducing electromagnetic interference. By urging ground terminals against a shielding shell to form a grounding structure, the grounding effect of the electrical connector can be improved.

In certain embodiments, an electrical connector includes an insulating body having a base and a tongue located at the front end of the base, a shielding shell sleeved outside the base and the tongue and forming a mating space, and multiple upper-row terminals and multiple lower-row terminals fixed to the base. Each of the upper-row and lower-row terminals has a contacting portion exposed from the upper surface or the lower surface of the tongue, a soldering portion extending out of the base, and a connecting portion located between the contacting portion and the soldering portion. The upper-row terminals and the lower-row terminals are respectively provided with at least one upper-row ground terminal and at least one lower-row ground terminal. An extending portion extends from the connecting portion of each upper-row ground terminal and each lower-row ground terminal. The cutting surface of each extending portion urges against the shielding shell.

In certain embodiments, each extending portion has a first bending portion. The first bending portion is bent backward in the horizontal direction to form a second bending portion. The cutting surface of the outer side of the second bending portion urges against the shielding shell.

In certain embodiments, a groove concavely is formed in the base, each first bending portion is retained in the base, each second bending portion is located in the groove, and the cutting surface of the outer side of each second bending portion urges against the shielding shell in the groove.

In certain embodiments, the second bending portions are away from the connecting portions relative to the first bending portions.

In certain embodiments, a groove is concavely formed in the base, the rear plate edge of each extending portion is exposed from the groove, the shielding shell is provided with at least one elastic arm extending into the groove, and the rear plate edge urges against each elastic arm in the front-rear direction.

In certain embodiments, the number of the elastic arms is two, the two elastic arms are arranged on the shielding shell in a vertically symmetrical mode and extend into the groove, and the cutting surfaces of the two elastic arms urge against the rear plate edges of the upper-row ground terminals and the rear plate edges of the lower-row ground terminals, respectively.

In certain embodiments, the extending portions transversely extend from the connecting portions in the horizontal direction.

In certain embodiments, an upper grounding sheet and a lower grounding sheet are respectively fixed on the upper surface and the lower surface of the tongue. The upper grounding sheet and the lower grounding sheet are each provided with a first section and a second section. Each first section is fixedly arranged at the position, near the base, of the tongue. Each second section covers the position, close to the tongue, of the base. A vertical section is arranged between each first section and the corresponding second section. Each vertical section is attached to the connecting surface of the base and the tongue.

In certain embodiments, a middle shielding sheet is located between the multiple upper-row terminals and the multiple lower-row terminals. The middle shielding sheet has a main body portion. The main body portion is retained in the tongue and is located between the contacting portions of the upper-row terminals and the contacting portions of the lower-row terminals. The two sides of the tongue are each concavely provided with a notch. Buckling slots are formed in the positions, corresponding to the notches, of the main body portion.

In certain embodiments, two grounding pins extend backward out of the base from the two sides of the main body portion, respectively. A metal shell is sleeved outside the shielding shell. The grounding pins urge against the metal shell.

Compared with the related art, the extending portions are arranged on the connecting portion of each upper-row ground terminal and the connecting portion of each lower-row ground terminal of the electrical connector according to certain embodiments of the present invention, and the cutting surface of each extending portion urges against the shielding shell to form a grounding structure, so that the grounding portion and grounding area of the electrical connector are increased, the grounding effect is improved and the high-frequency transmission performance of the electrical connector is ensured.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the invention and together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
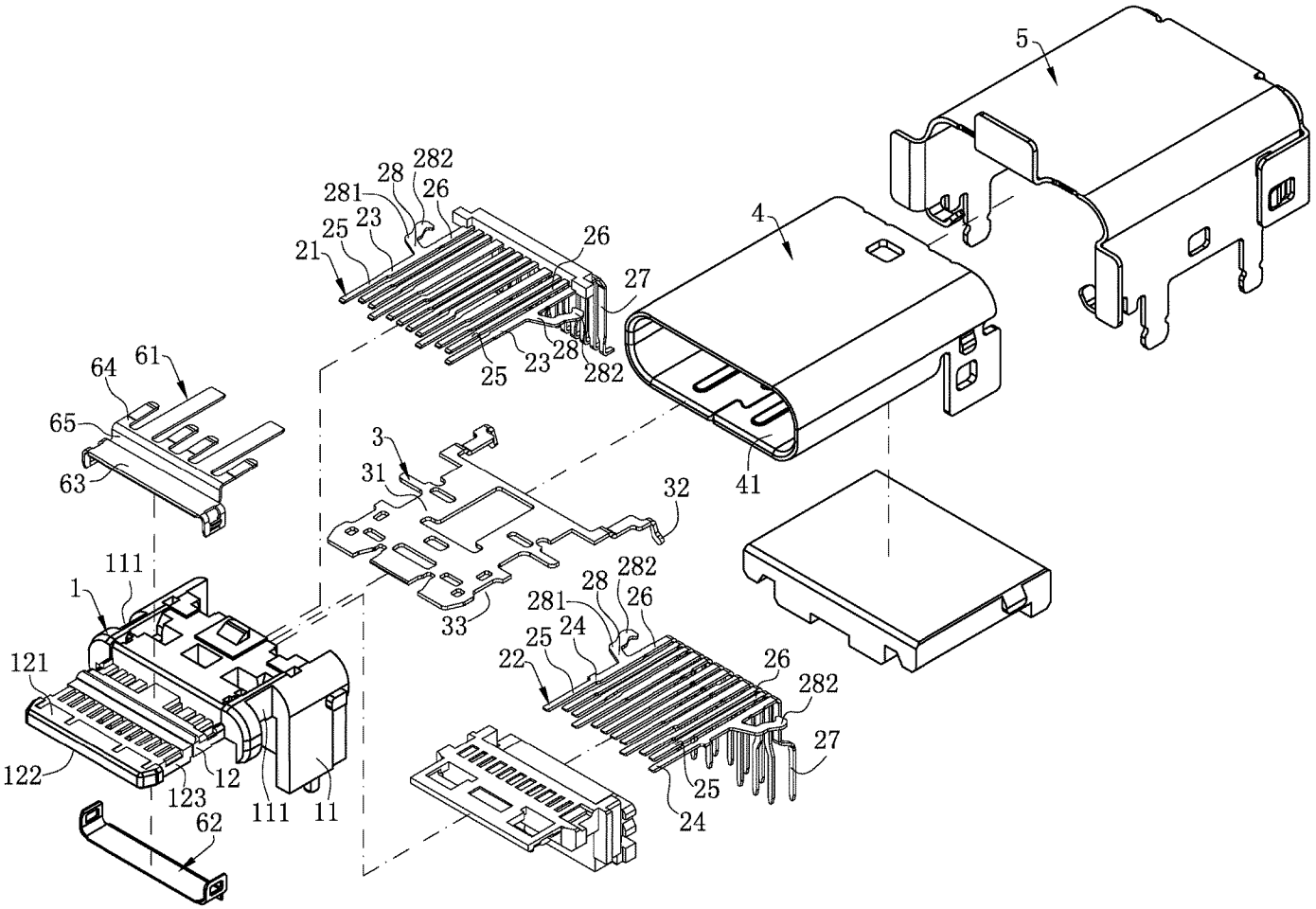
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-13. In accordance with the purposes of this invention, as embodied and broadly described herein, this invention, in one aspect, relates to an electrical connector.

Figure 3:
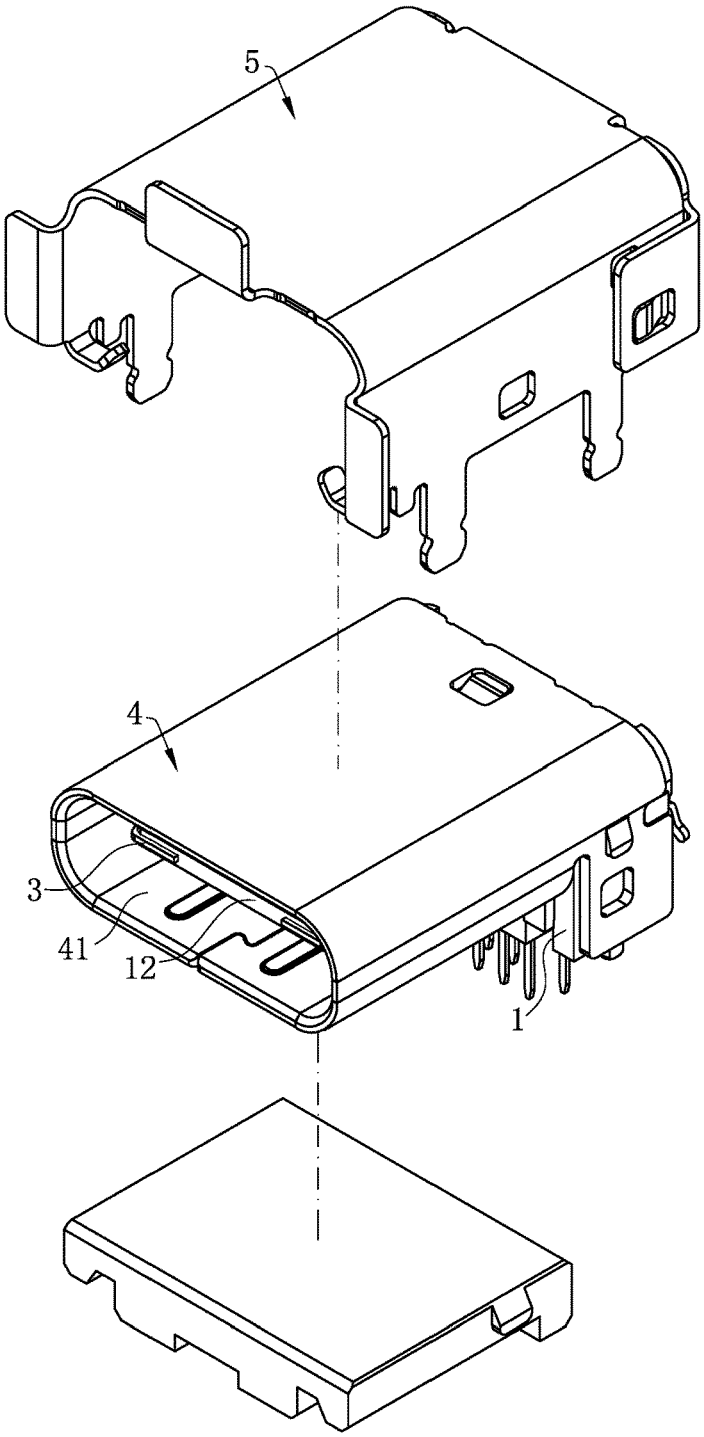
FIG. 3 is a schematic three-dimensional partial assembly view of the electrical connector according to one embodiment of the present invention from another angle.
Figure 4:
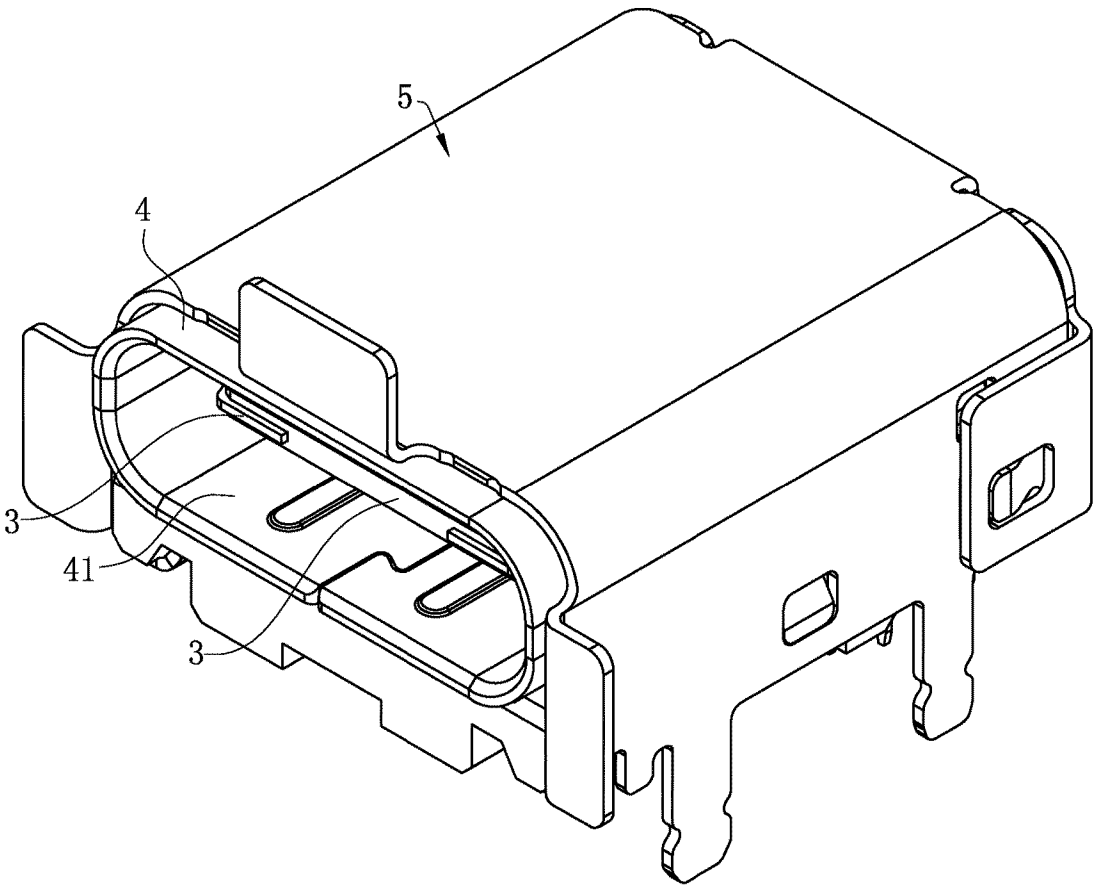
FIG. 4 is a schematic three-dimensional assembly view of the electrical connector according to one embodiment of the present invention.

Referring to FIGS. 1 and 4, an electrical connector according to one embodiment of the present invention includes an insulating body 1, a shielding shell 4 sleeved over the insulating body 1 to form a mating space 41, a metal shell 5 sleeved over the shielding shell 4 (as shown in FIG. 3), multiple upper-row terminals 21, multiple lower-row terminals 22 and a middle shielding sheet 3 fixed to the insulating body 1, and a pair of grounding sheets including an upper grounding sheet 61 and a lower grounding sheet 62.

The insulating body 1 has a base 11 and a tongue 12 located at the front end of the base 11. Two grooves 111 are concavely formed in the base 11 and are respectively located in the two sides of the base 11. The tongue 12 has an upper surface 121 and a lower surface 122. The two sides of the tongue 12 are respectively recessed with a notch 123.

Figure 5:
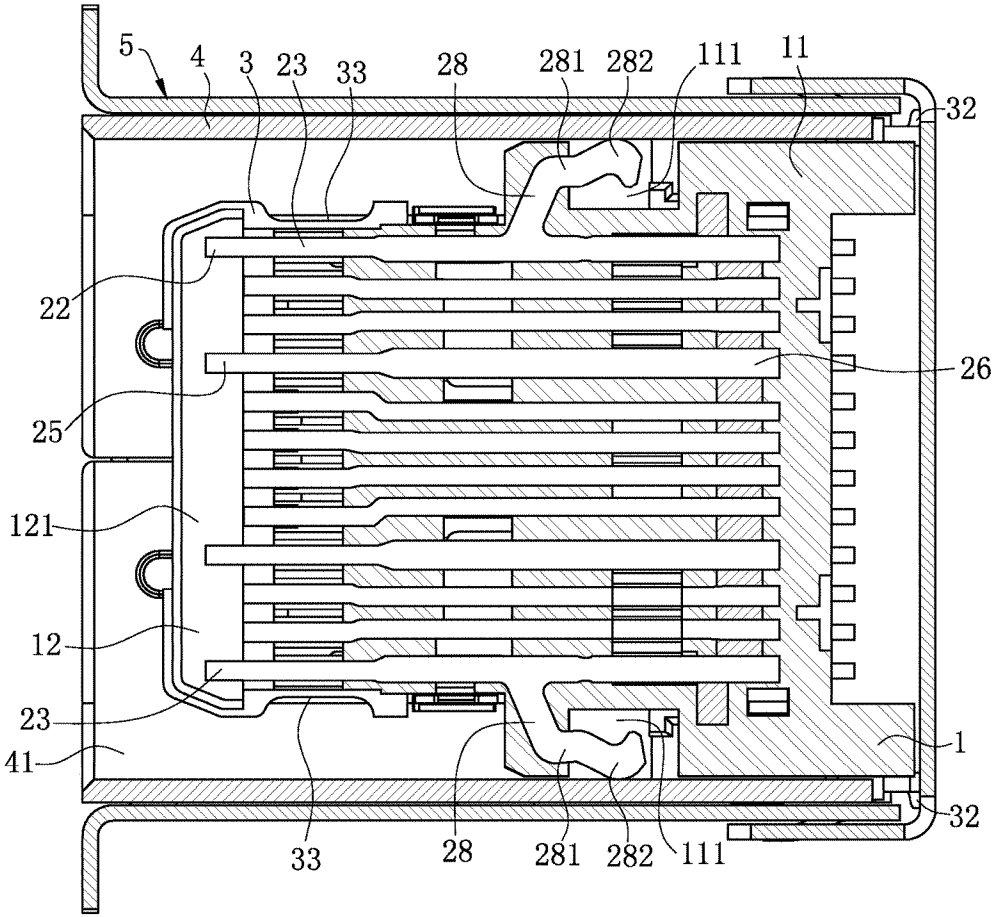
FIG. 5 is a local sectional view of the electrical connector according to one embodiment of the present invention.

As shown in FIGS. 1 and 5, the multiple upper-row terminals 21 and the multiple lower-row terminals 22 are fixed to the base 11. Each of the upper-row terminals 21 and the lower-row terminals 22 has a contacting portion 25 exposed from the upper surface 121 or the lower surface 122 of the tongue 12, a soldering portion 27 extending out of the base 11, and a connecting portion 26 located between the contacting portion 25 and the soldering portion 27. The upper-row terminals 21 and the lower-row terminals 22 includes respectively two upper-row ground terminals 23 and two lower-row ground terminals 24. An extending portion 28 extends from the connecting portion 26 of each upper-row ground terminal 23, an extending portion 28 extends from the connecting portion 26 of each lower-row ground terminal 24, and the extending portions 28 extend transversely from the connecting portions 26 in the horizontal direction. Each extending portion 28 has a first bending portion 281. The first bending portion 281 is horizontally bent backward to form a second bending portion 282. The second bending portion 282 is away from the corresponding connecting portion 26 relative to the first bending portion 281. The first bending portion 281 is retained in the base 11, the second bending portion 282 is located in the corresponding groove 111, and the cutting surface of the outer side of the second bending portion 282 urges against the shielding shell 4.

Figure 2:
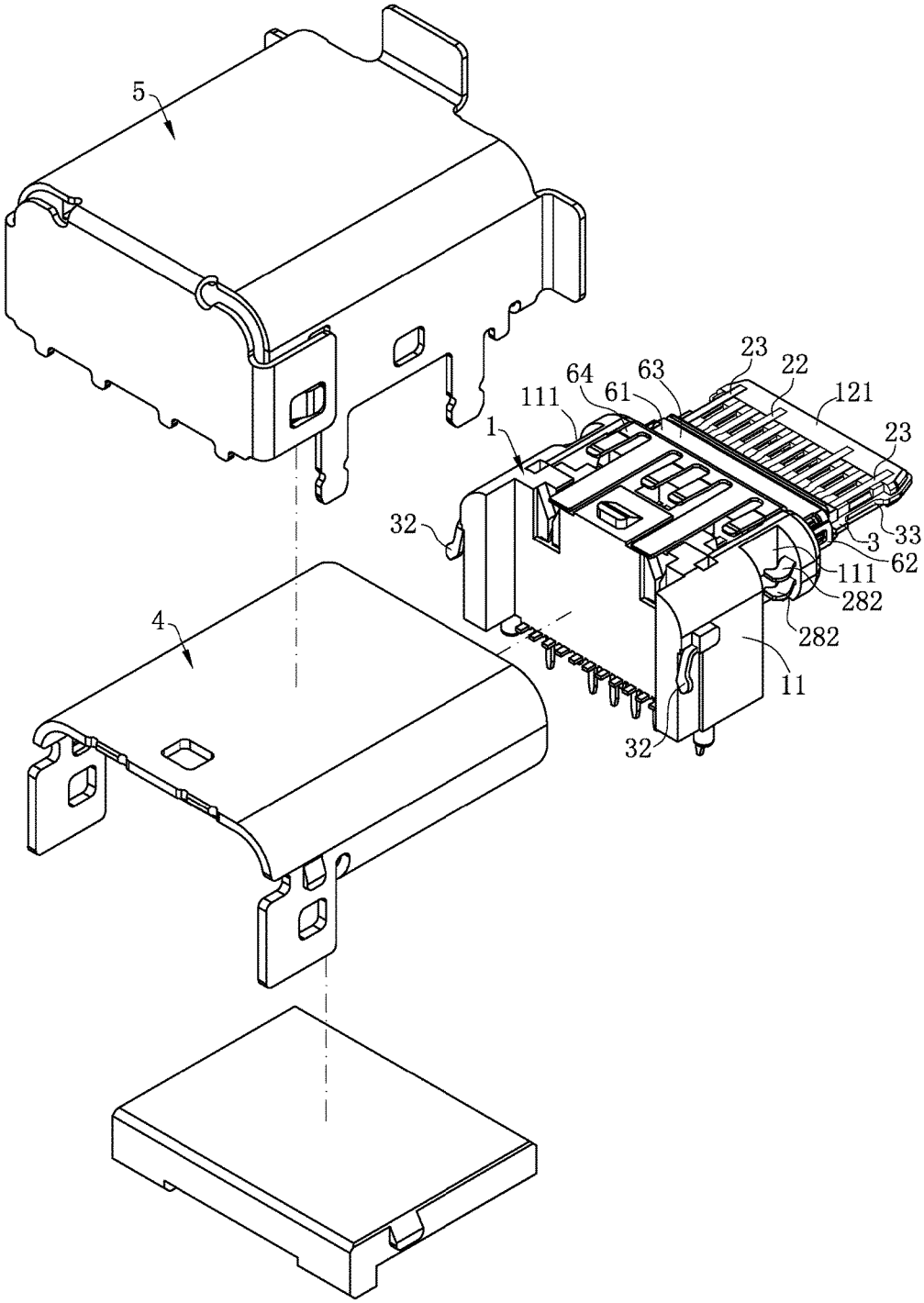
FIG. 2 is a schematic three-dimensional partial assembly view of the electrical connector according to one embodiment of the present invention.

As shown in FIGS. 1 and 2, a middle shielding sheet 3 is located between the multiple upper-row terminals 21 and the multiple lower-row terminals 22. The middle shielding sheet 3 has a main body portion 31. The main body portion 31 is retained in the tongue 12 and is located between the contacting portions 25 of the upper-row terminals 21 and the contacting portions 25 of the lower-row terminals 22. Buckling slots 33 are formed in the positions, corresponding to the notches 123 of the tongue 12, of the main body portion 31. Two grounding pins 32 respectively extend backward out of the base 11 from the two sides of the main body portion 31, and the grounding pins 32 urge against the metal shell 5.

Figure 6:
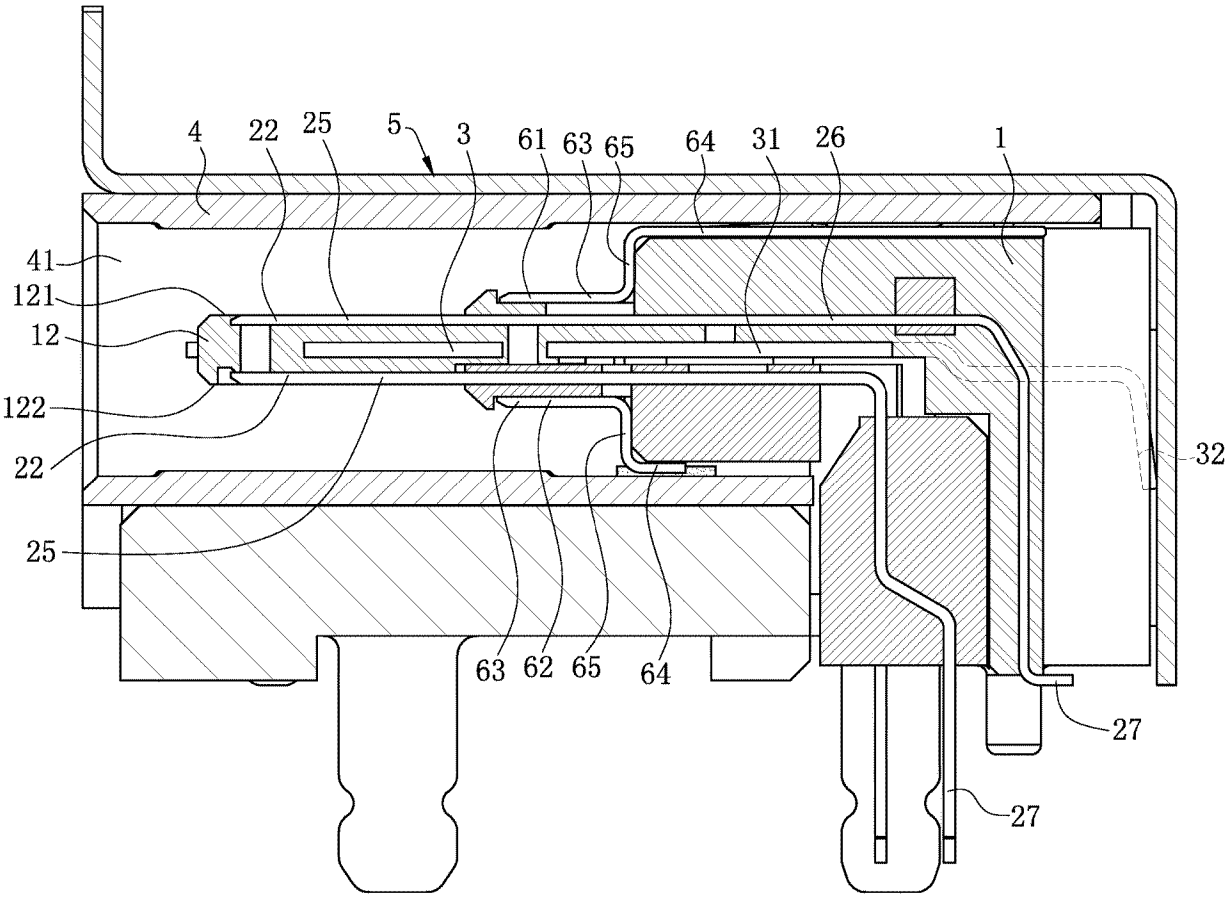
FIG. 6 is a local sectional view of the electrical connector according to one embodiment of the present invention from another angle.
Figure 7:
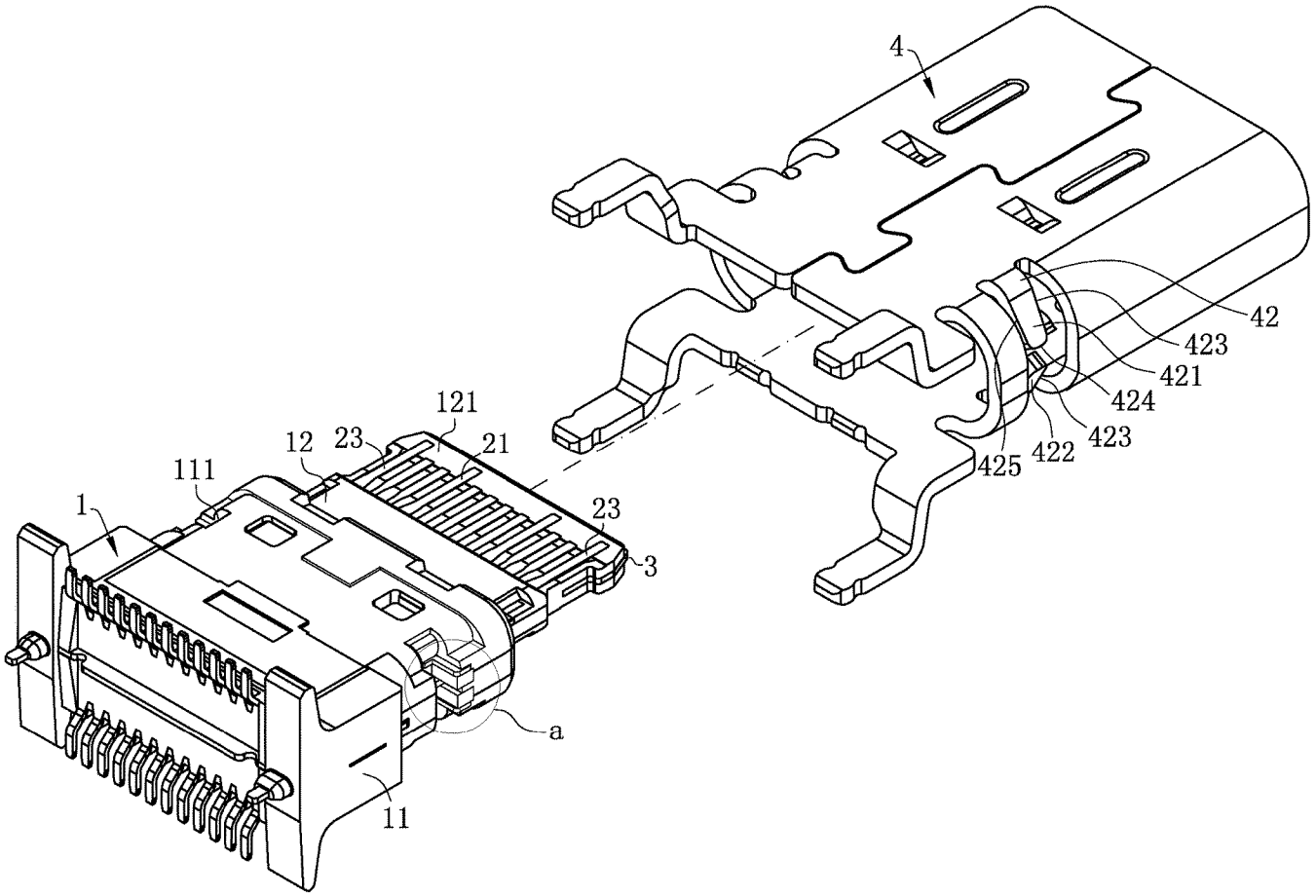
FIG. 7 is a schematic three-dimensional partial assembly view of an electrical connector according to a second embodiment of the present invention.
Figure 8:
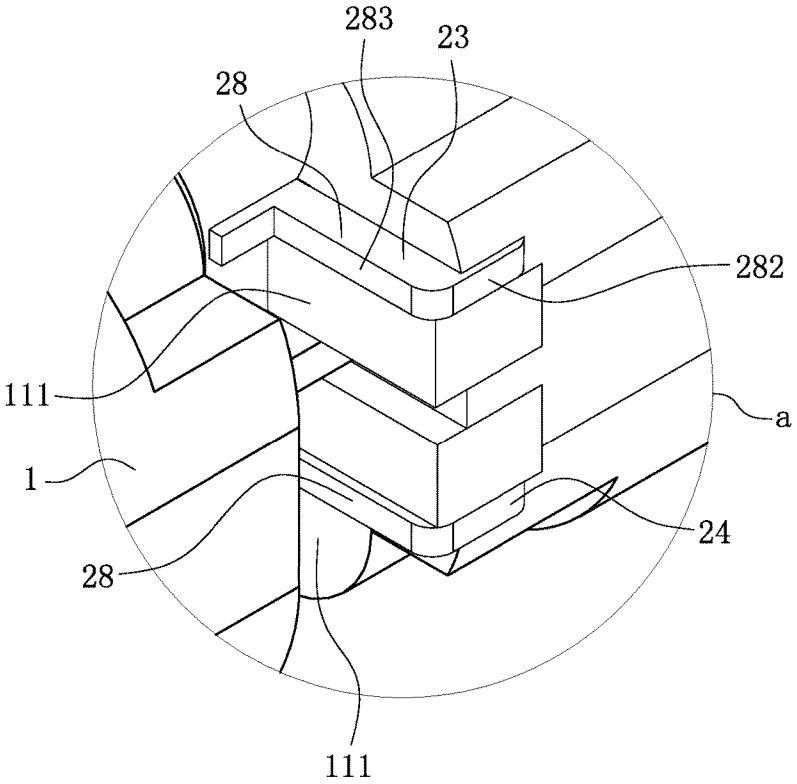
FIG. 8 is an enlarged view of part a in FIG. 7.
Figure 9:
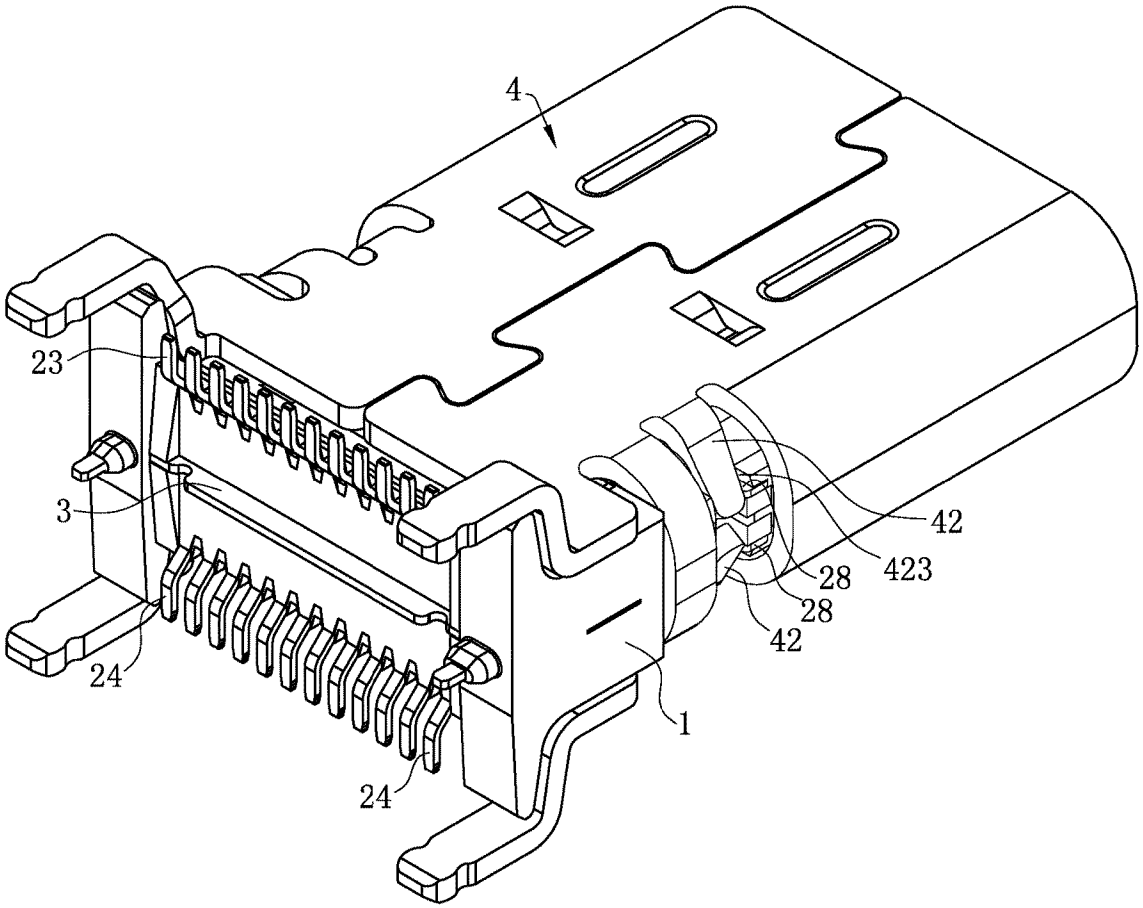
FIG. 9 is a schematic three-dimensional assembly view of the electrical connector according to the second embodiment of the present invention.
Figure 10:
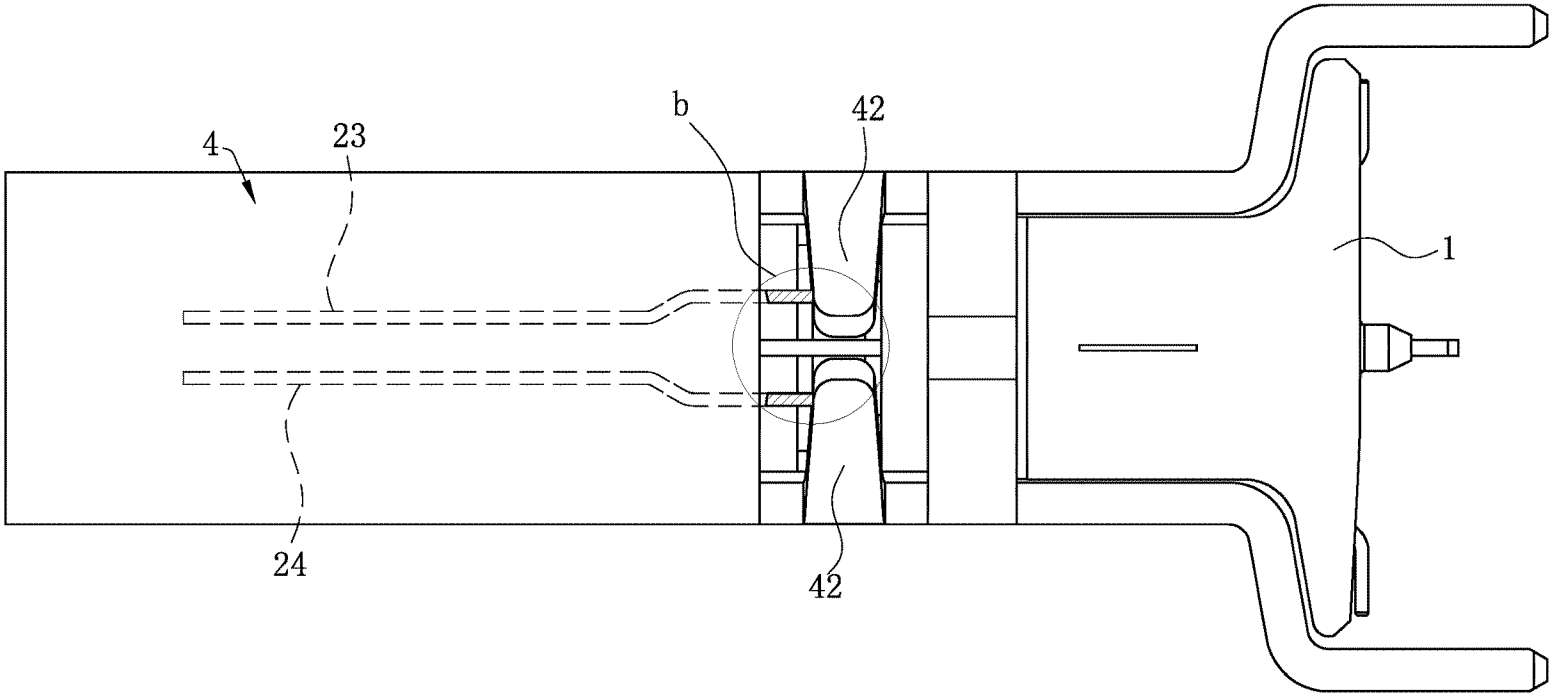
FIG. 10 is a local sectional view of the electrical connector according to the second embodiment of the present invention.
Figure 11:
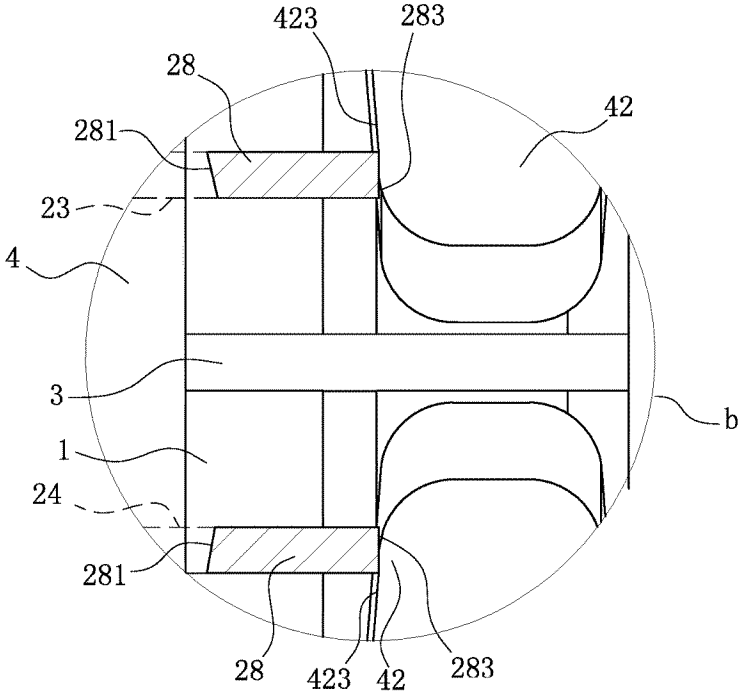
FIG. 11 is an enlarged view of part b in FIG. 10.
Figure 12:
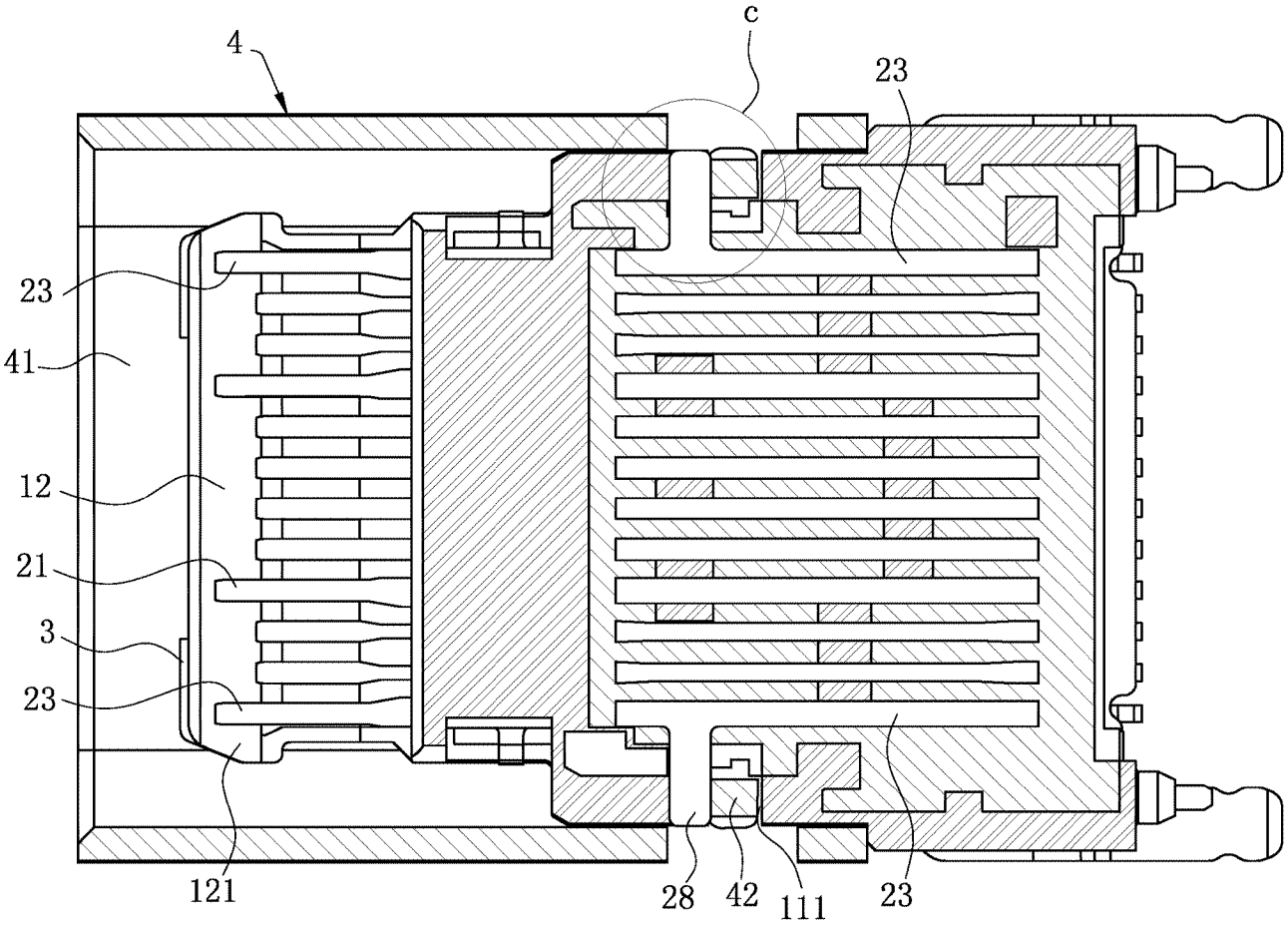
FIG. 12 is a local sectional view of the electrical connector according to the second embodiment of the present invention from another angle.
Figure 13:
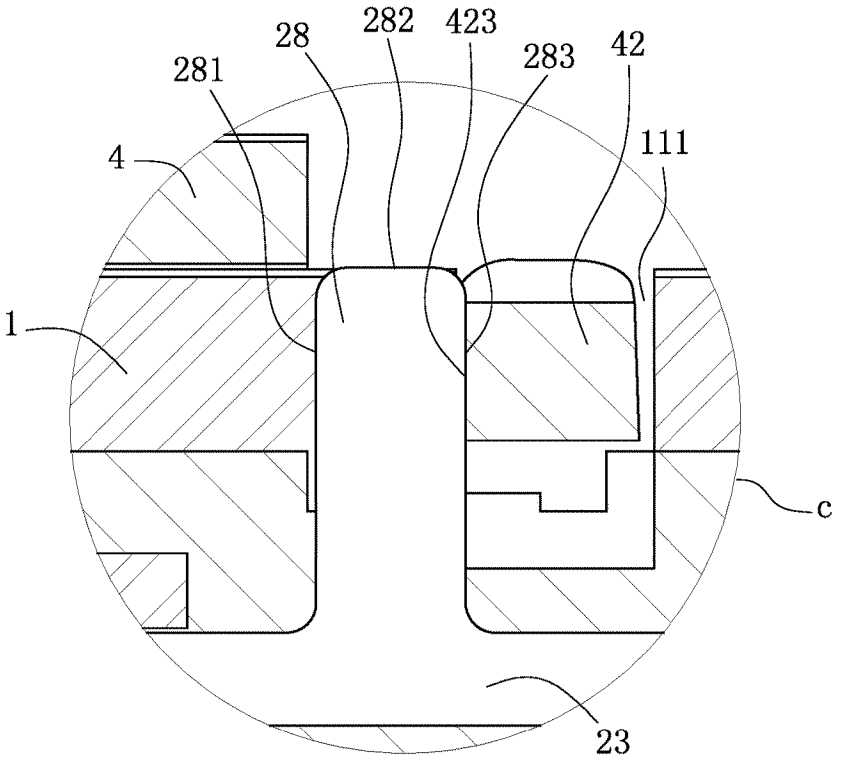
FIG. 13 is an enlarged view of part c in FIG. 12.

As shown in FIGS. 1 and 6, the upper grounding sheet 61 and the lower grounding sheet 62 are respectively fixed on the upper surface 121 and the lower surface 122 of the tongue 12. The upper grounding sheet 61 and the lower grounding sheet 62 are respectively provided with a first section 63 and a second section 64. Each first section 63 is located at the position of the tongue 12 that is close to the base 11. Each second section 64 covers the position of the base 11 that is close to the tongue 12. A vertical section 65 is arranged between each first section 63 and the corresponding second section 64. Each vertical section 65 is attached to the connecting surface of the base 11 and the tongue 12.

FIGS. 7-13 show the second embodiment of the present invention. The second embodiment is different from the first embodiment in that: each extending portion 28 is provided with a front plate edge 281, a side plate edge 282 and a rear plate edge 283, and the rear plate edge 283 of the extending portion 28 is exposed in the corresponding groove 111. The shielding shell 4 is provided with two elastic arms 42, including an upper elastic arm 421 and a lower elastic arm 422, which are in a vertical symmetrical mode and extend into the grooves 111. Each elastic arm 42 has a front plate edge 423, a side plate edge 424 and a rear plate edge 425. The front plate edge 423 of the upper elastic arm 421 urges against the rear plate edge 283 of the extending portion 28 of the upper-row ground terminals 23 in the corresponding groove 111, the front plate edge 423 of the lower elastic arm 422 urges against the rear plate edge 283 of the extending portion 28 of the lower-row ground terminals 24 in the corresponding groove 111 (as shown in FIGS. 9-13), and detailed description is omitted here.

In summary, the electrical connector according to certain embodiments of the present invention has the following beneficial advantages:

(1) The extending portions 28 are arranged on the connecting portion 26 of each upper-row ground terminal 23 and the connecting portion 26 of each lower-row ground terminal 24 of the electrical connector, and the cutting surface of each extending portion 28 urges against the shielding shell 4 to form a grounding structure, so that the grounding portion and grounding area of the electrical connector are increased, the grounding effect is improved and the high-frequency transmission performance of the electrical connector is ensured.

(2) The first bending portions 281 are retained in the base 11 to enable the extending portions 28 to be more stable, and the second bending portions 282 are located in the grooves 111 so as to have motion space to elastically urge against the shielding shell 4. In this way, during assembly of the shielding shell 4, the second bending portions 282 will not prevent the shielding shell 4 from being sleeved over the insulating body 1.

(3) In another embodiment, the front plate edge 423 of the upper elastic arm 421 urges against the rear plate edge 283 of the extending portion 28 of the upper-row ground terminals 23 in the corresponding groove 111, the front plate edge 423 of the lower elastic arm 422 urges against the rear plate edge 283 of the extending portion 28 of the lower-row ground terminals 24 in the corresponding groove 111. In this way, the grounding portion and grounding area of the electrical connector are increased, the grounding effect is improved, and the insulating body 1 can be fixed more stably due to the fact that the elastic arms 42 can prevent the insulating body 1 from moving front and back after extending into the grooves 111.

(4) The upper grounding sheet 61 and the lower grounding sheet 62 are respectively fixedly arranged on the upper surface 121 and lower surface 122 of the tongue 12 to shield signal terminals against outside interference, so that a shielding structure can be formed and the high-frequency transmission performance of the electrical connector can be ensured.

(5) Two grounding pins 32 of the middle shielding sheet 3 respectively extend backward out of the base 11 from the two sides of the main body portion 31, and the grounding pins 32 urge against the metal shell 5, so that a grounding structure can be formed and the grounding effect of the electrical connector can be improved.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body having a base and a tongue located at a front end of the base;

a shielding shell sleeved over the base and the tongue and forming a mating space; and a plurality of upper-row terminals and a plurality of lower-row terminals fixed on the base, wherein each of the upper-row terminals and lower-row terminals has a contacting portion exposed from upper surface or lower surface of the tongue, a soldering portion extending out of the base, and a connecting portion located between the contacting portion and the soldering portion;

wherein the upper-row terminals and the lower-row terminals respectively comprises at least one upper-row ground terminal and at least one lower-row ground terminal, an extending portion extends from the connecting portion of each of the at least one upper-row ground terminal and the at least one lower-row ground terminal, and a cutting surface of each of the extending portions urges against the shielding shell; and wherein each of the extending portions comprises a first bending portion and a second bending portion bending backward horizontally from the first bending portion, and a cutting surface of an outer side of the second bending portion urging against the shielding shell.

2. The electrical connector of claim 1, wherein a groove is concavely formed in the base, the first bending portions are retained in the base, the second bending portions are located in the groove, and the cutting surface of the outer side of each of the second bending portions urges against the shielding shell in the groove.

3. The electrical connector of claim 1, wherein each of the second bending portions is away from corresponding one of the connecting portions relative to corresponding one of the first bending portions.

4. The electrical connector of claim 1, wherein each of the extending portions transversely extends from corresponding one of the connecting portions in the horizontal direction.

5. The electrical connector of claim 1, further comprising an upper grounding sheet and a lower grounding sheet respectively fixed on an upper surface and a lower surface of the tongue, wherein each of the upper grounding sheet and the lower grounding sheet comprises a first section fixed at a position of the tongue that is close to the base, a second section covering a position of the base that is close to the tongue, and a vertical section disposed between the first section and the second section, and each of the vertical sections is attached to a connecting surface of the base and the tongue.

6. The electrical connector of claim 1, further comprising a middle shielding sheet located between the upper-row terminals and the lower-row terminals, wherein the middle shielding sheet has a main body portion, the main body portion is retained in the tongue and located between the contacting portions of the upper-row terminals and the contacting portions of the lower-row terminals, each of two sides of the tongue is concavely provided with a notch, and buckling slots are formed in positions of the main body portion corresponding to the notches.

7. The electrical connector of claim 6, wherein two grounding pins respectively extend backward out of the base from the two sides of the main body portion, a metal shell is sleeved over the shielding shell, and the grounding pins urge against the metal shell.

8. An electrical connector, comprising:

an insulating body having a base and a tongue located at a front end of the base;

a shielding shell sleeved over the base and the tongue and forming a mating space; and a plurality of upper-row terminals and a plurality of lower-row terminals fixed on the base, wherein each of the upper-row terminals and lower-row terminals has a contacting portion exposed from upper surface or lower surface of the tongue, a soldering portion extending out of the base, and a connecting portion located between the contacting portion and the soldering portion;

wherein the upper-row terminals and the lower-row terminals respectively comprises at least one upper-row ground terminal and at least one lower-row ground terminal, an extending portion extends from the connecting portion of each of the at least one upper-row ground terminal and the at least one lower-row ground terminal, and a cutting surface of each of the extending portions urges against the shielding shell; and wherein a groove is concavely formed in the base, a rear plate edge of each of the extending portions is exposed to the groove, the shielding shell comprises at least one elastic arm extending into the groove, and the rear plate edge of each of the extending portions urges against corresponding one of the at least one elastic arm in a front-rear direction.

9. The electrical connector of claim 8, wherein a number of the at least one elastic arm is two, the two elastic arms are arranged on the shielding shell in a vertically symmetrical mode and extend into the groove, and plate edges of the two elastic arms respectively urge against the rear plate edge of the at least one upper-row ground terminal and a rear plate edges of the at least one lower-row ground terminals.

10. The electrical connector of claim 8, wherein each of the extending portions transversely extends from corresponding one of the connecting portions in the horizontal direction.

11. The electrical connector of claim 8, further comprising an upper grounding sheet and a lower grounding sheet respectively fixed on an upper surface and a lower surface of the tongue, wherein each of the upper grounding sheet and the lower grounding sheet comprises a first section fixed at a position of the tongue that is close to the base, a second section covering a position of the base that is close to the tongue, and a vertical section disposed between the first section and the second section, and each of the vertical sections is attached to a connecting surface of the base and the tongue.

12. The electrical connector of claim 8, further comprising a middle shielding sheet located between the upper-row terminals and the lower-row terminals, wherein the middle shielding sheet has a main body portion, the main body portion is retained in the tongue and located between the contacting portions of the upper-row terminals and the contacting portions of the lower-row terminals, each of two sides of the tongue is concavely provided with a notch, and buckling slots are formed in positions of the main body portion corresponding to the notches.

13. The electrical connector of claim 12, wherein two grounding pins respectively extend backward out of the base from the two sides of the main body portion, a metal shell is sleeved over the shielding shell, and the grounding pins urge against the metal shell.

* * * * *